US005568168A

United States Patent [19]

Watanabe

[11] Patent Number: 5,568,168

[45] Date of Patent: Oct. 22, 1996

[54] RECORDING METHOD WITH SCANNING BOUNDARY STREAK REDUCTION

[75] Inventor: Kenjiro Watanabe, Tokyo, Japan

[73] Assignee: Canon Kabushiki Kaisha, Tokyo, Japan

[21] Appl. No.: 28,612

[22] Filed: Mar. 8, 1993

Related U.S. Application Data

[63] Continuation of Ser. No. 866,298, Apr. 13, 1992, abandoned, which is a continuation of Ser. No. 489,356, Mar. 6, 1990, abandoned.

[30] Foreign Application Priority Data

Mar. 7, 1989 [JP] Japan ..... 1-052862

[51] Int. Cl.[6] ..... B41J 2/21

[52] U.S. Cl. ..... 347/43

[58] Field of Search ..... 346/1.1, 140; 347/43, 347/40, 41

[56] References Cited

U.S. PATENT DOCUMENTS

| | | | |
|---|---|---|---|
| 4,272,771 | 6/1981 | Furukawa | 347/40 X |
| 4,313,124 | 1/1982 | Hara . | |
| 4,345,262 | 8/1982 | Shirato et al. . | |
| 4,364,067 | 12/1982 | Koto | 347/70 |
| 4,459,600 | 7/1984 | Sato et al. . | |
| 4,463,359 | 7/1984 | Ayata et al. . | |
| 4,558,333 | 12/1985 | Sugitani et al. . | |
| 4,586,054 | 4/1986 | Kurita | 347/206 |
| 4,723,129 | 2/1988 | Endo et al. . | |
| 4,740,796 | 4/1988 | Endo et al. . | |
| 4,855,752 | 8/1989 | Bergstedt | 347/41 |

FOREIGN PATENT DOCUMENTS

| | | | |
|---|---|---|---|
| 54-56847 | 5/1979 | Japan | B41M 5/26 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 60-120066 | 6/1985 | Japan | B41J 3/04 |
| 77951 | 4/1987 | Japan | B41J 3/04 |

*Primary Examiner*—Joseph W. Hartary

*Attorney, Agent, or Firm*—Fitzpatrick, Cella, Harper & Scinto

[57] ABSTRACT

There is disclosed a recording method with plural recording heads, capable of avoiding the formation of a white streak or a dark streak in the recorded image, even in the presence of an error in the feeding amount of the recording sheet. The position of the plural recording elements on each recording head is mutually displaced in the feeding direction of the recording sheet relative to the other recording heads, so that such white streak can be filled in at least with one color and becomes less conspicuous.

17 Claims, 7 Drawing Sheets

RECORDING METHOD WITH SCANNING BOUNDARY STREAK REDUCTION

This application is a continuation of application Ser. No. 07/866,298 filed Apr. 13, 1992, abandoned, which is a continuation of application Ser. No. 07/489,356 filed Mar. 6, 1990, abandoned.

BACKGROUND OF THE INVENTION

1. Field of the Invention

The present invention relates to a recording apparatus, and more particularly to a recording apparatus in which plural recording heads are arranged in parallel manner and effect scanning operation in the direction of arrangement of said recording heads, thereby recording plural colors.

2. Related Background Art

An example of such conventional recording apparatus is illustrated in FIGS. 5 and 6, wherein recording heads 1Y, 1M, 1C and 1B, arranged at a same height with a given spacing for respectively recording yellow (Y), magenta (M), cyan (C) and black (B) colors, are supported on a carriage 2 and driven along a sliding shaft 3 by unrepresented driving means, for effecting the recording on a recording material during the movement. Recording elements 5Y–5B are arranged, respectively on faces 6Y–6B, facing said recording material, of the recording heads 1Y–1B, in perpendicular arrangement to the scanning direction of said heads with constant pitch at a mutually same height, and the recording is made on the recording material by selective drive of said recording elements 5Y–5B.

However, in such conventional recording apparatus, in case of even density recording with two mixed colors, for example red (R) with yellow (Y) and magenta (M), the recording becomes continuous without boundary between the first and second scannings, as shown in FIG. 7A, by the arrangement of dots (Y) and (M) if the recording material 4 is advanced by the predetermined amount l without error in a direction perpendicular to the scanning direction. However, if the amount of advancement of the recording material is increased by Δl, there will appear a blank, or so-called "white streak" as shown in FIG. 7B between the first and second scannings, thus deteriorating the quality of recording.

On the other hand, if the amount of advancement is decreased by Δl, there will appear overlapping of the dots between the first and second scannings, thus generating an unpleasant "dark streak" though it is not illustrated.

SUMMARY OF THE INVENTION

In consideration of the foregoing an object of the present invention is to provide a recording apparatus capable of reducing the image uneveness in the advancing direction of the recording material, thereby improving the quality of the recorded image.

Another object of the present invention is to provide a recording apparatus which is equipped with plural recording heads each provided with equally spaced plural recording elements and arranged perpendicularly to the scanning direction, and which effects recording by moving said recording heads in parallel manner and feeding the recording material perpendicularly to the scanning direction, wherein the position of said plural recording elements or the usable range thereof is displaced by a predetermined amount in the feeding direction of the recording material, among different recording heads.

According to the present invention, since, in plural recording heads arranged in parallel manner in the scanning direction, the position of each of plural recording elements in the feeding direction of the recording material in said recording heads or the usable range of said recording elements of each recording head is displaced by a predetermined amount relative to the other recording heads, a blank portion or an overlapping portion eventually generated at the boundary between a scanning motion and a next scanning motion is diluted by one of two colors to be mixed, thereby suppressing the deterioration in the record quality resulting from unevenness in the feeding amount of the recording material.

DESCRIPTION OF THE PREFERRED EMBODIMENTS

Now the present invention will be clarified in detail by embodiments thereof shown in the attached drawings.

Figure 1:
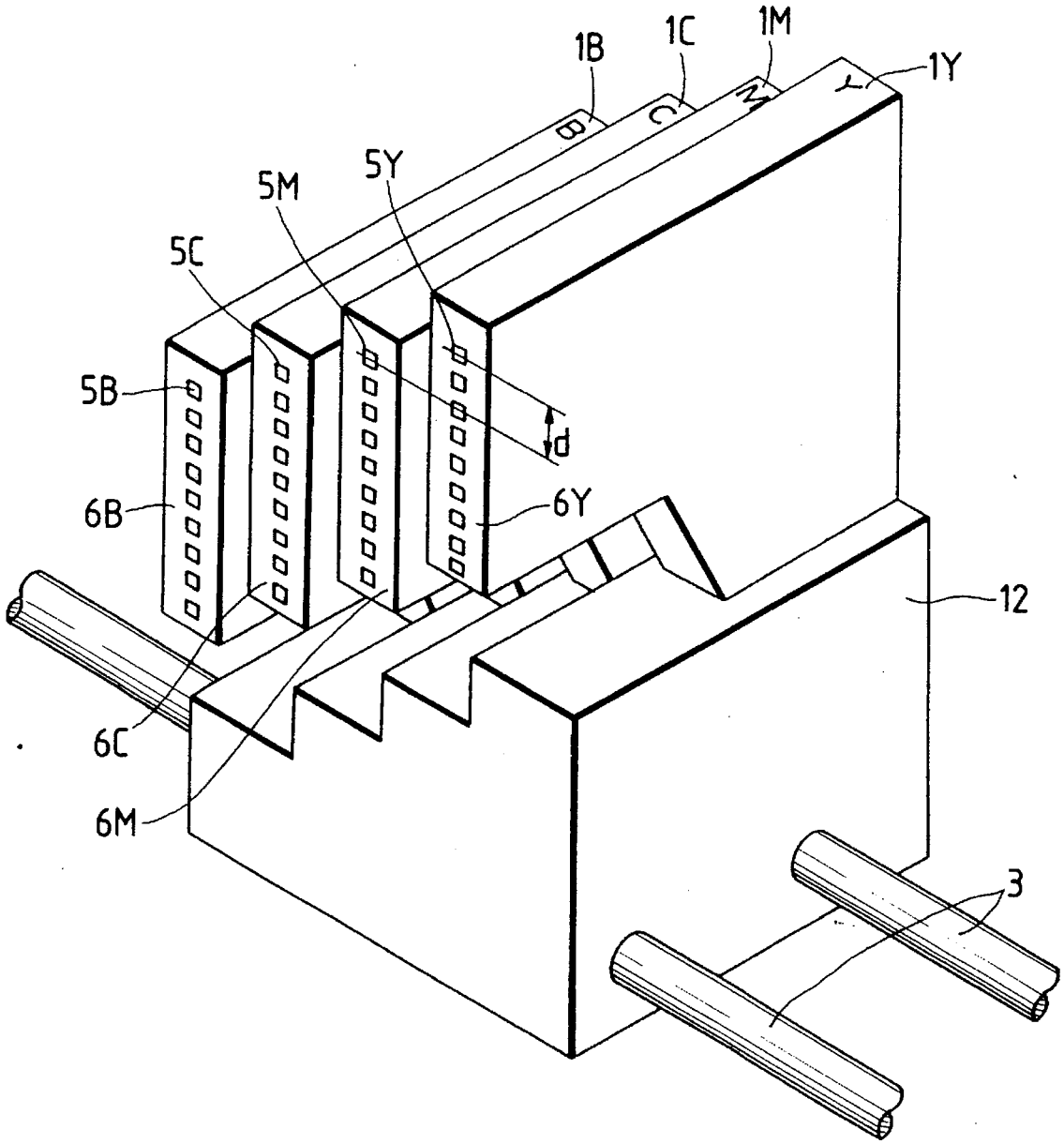
FIG. 1 is a perspective view of an example of the structure of the recording heads of the present invention.
Figure 2:
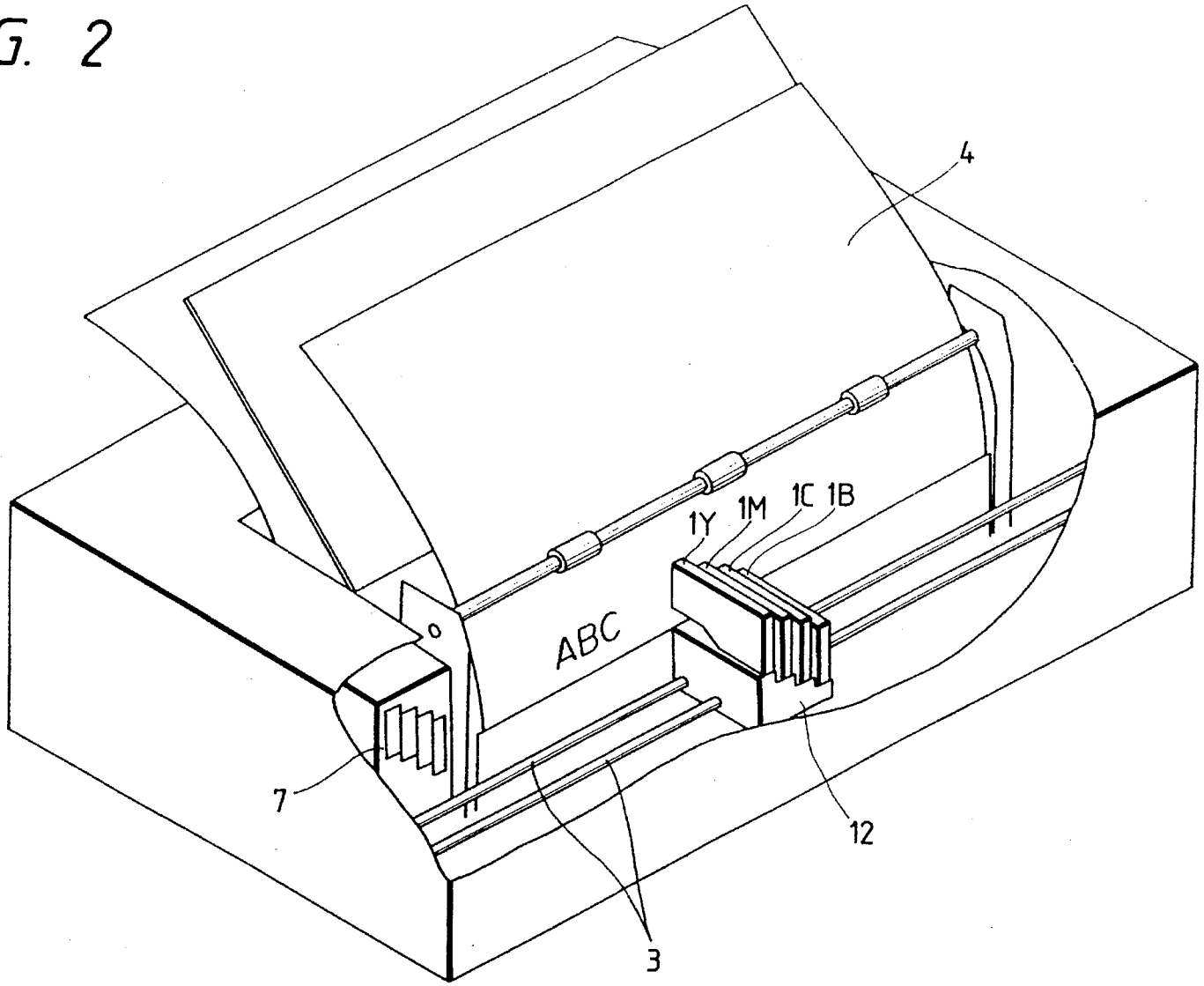
FIG. 2 is a perspective view of an example of the structure of the recording apparatus of the present invention.

FIGS. 1 and 2 illustrate an embodiment of the present invention, wherein recording heads 1Y–1B are provided on faces 6Y–6B thereof opposed to the recording material, respectively with recording elements 5Y–5B arranged at a constant pitch in a direction perpendicular to the scanning direction, and are supported on a carriage 12 having steps in the vertical direction. Because of said vertical step d, a positional difference d is generated in the vertical direction, or in the feeding direction of the recording material, between the mutually corresponding recording elements of adjacent recording heads, for example between the uppermost recording element of the recording head 1Y and that of the head 1M. Likewise, a height difference d is formed between the mutually corresponding recording elements of adjacent recording heads 1M and 1C, and between heads 1C and 1B. In the present embodiment there is shown an ink jet recording apparatus as an example of the recording apparatus, and a cap member is provided, as shown in FIG. 2, for effecting the head recovery operation in contact with the recording heads 1Y–1B.

As an example, let us consider a case of d=2 p (p being the pitch of the recording elements in each recording head), namely a case in which the recording elements of the adjacent heads are displaced by two dots. In case of uniform red recording by mixing yellow and magenta colors by the scanning motion of the recording heads 1Y–1B of the above-explained structure, the "white streak" can be prevented as shown in FIG. 3 even when the amount l of advancement of the recording material is increased by Δl.

In this example, heads (or discharge port arrays) 1Y and 1M are scanned (along with heads 1C and 1B) transverse to the advancement direction of the recording material in two scans. In the first or one scan (FRONT STAGE in FIG. 3), heads 1Y and 1M record by ejecting droplets on the recording material in three areas or portions. During the first scan, the first area has droplets ejected on it by only head 1Y, the second area has droplets ejected on it by both heads 1Y and 1M, and the third area has droplets ejected on it by only head 1M. In the second scan or scan other than the one scan (REAR STAGE in FIG. 3), the third area noted above has droplet is ejected on it by only head 1Y.

Figure 3:
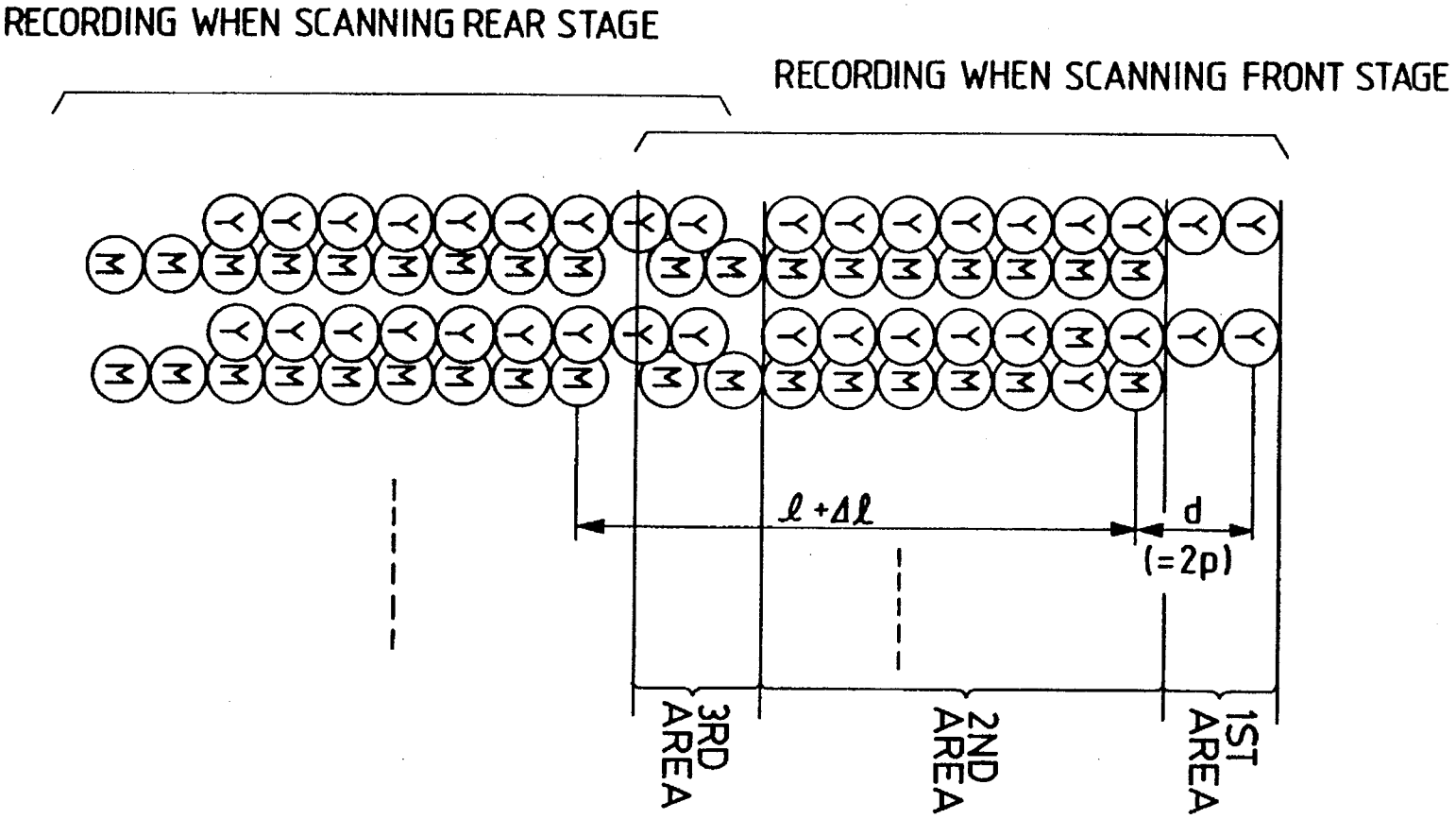
FIG. 3 is a schematic view of an example of recording according to the present invention.

The "white streak" can be prevented because the "white streak" formed in the yellow dots at the boundary of the first scanning and the second scanning is filled, as shown in FIG. 3, by the magenta dots at the lower end of the first scanning, due to the presence of the abovementioned displacement by 2 p or two dots, and becomes less conspicuous. Also the "dark streak" appearing at the boundary of two scanning motions in case the amount of feeding of the recording material is decreased can also be made less conspicuous by the substantially same reason.

Figure 4:
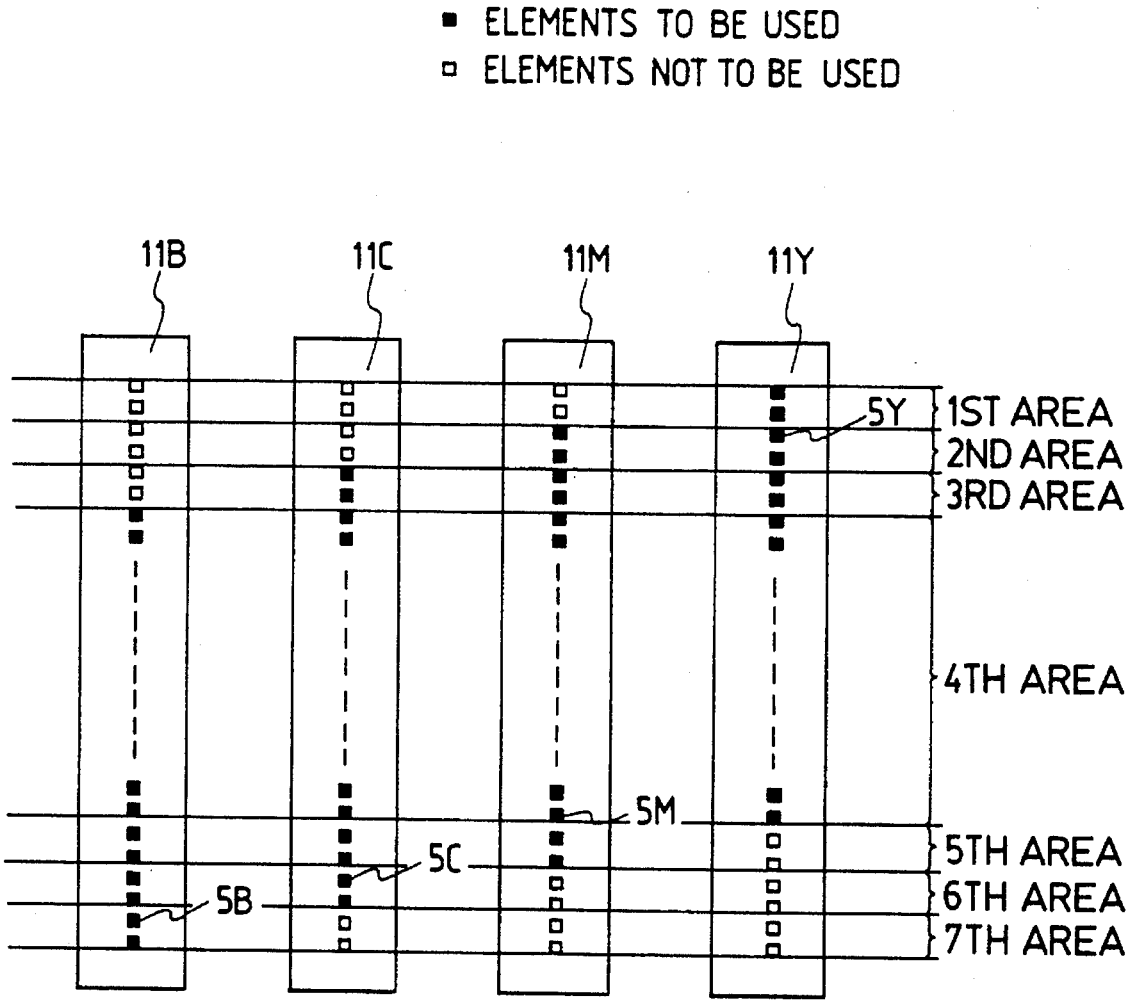
FIG. 4 is a front view of the structure of the recording heads in another embodiment of the present invention.
Figure 5:
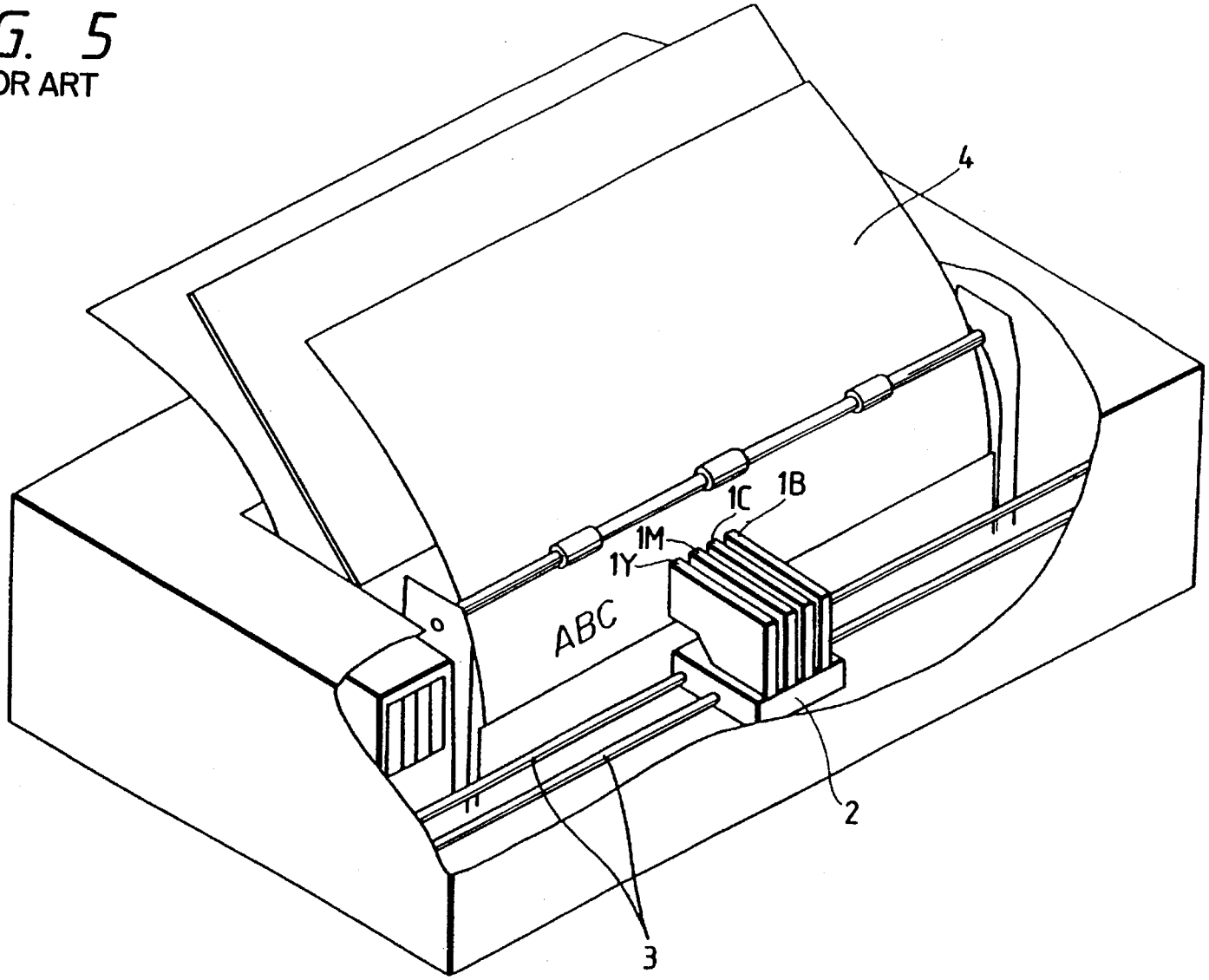
FIG. 5 PRIOR ART
FIG. 5 is a perspective view of an example of the conventional recording apparatus.
Figure 6:
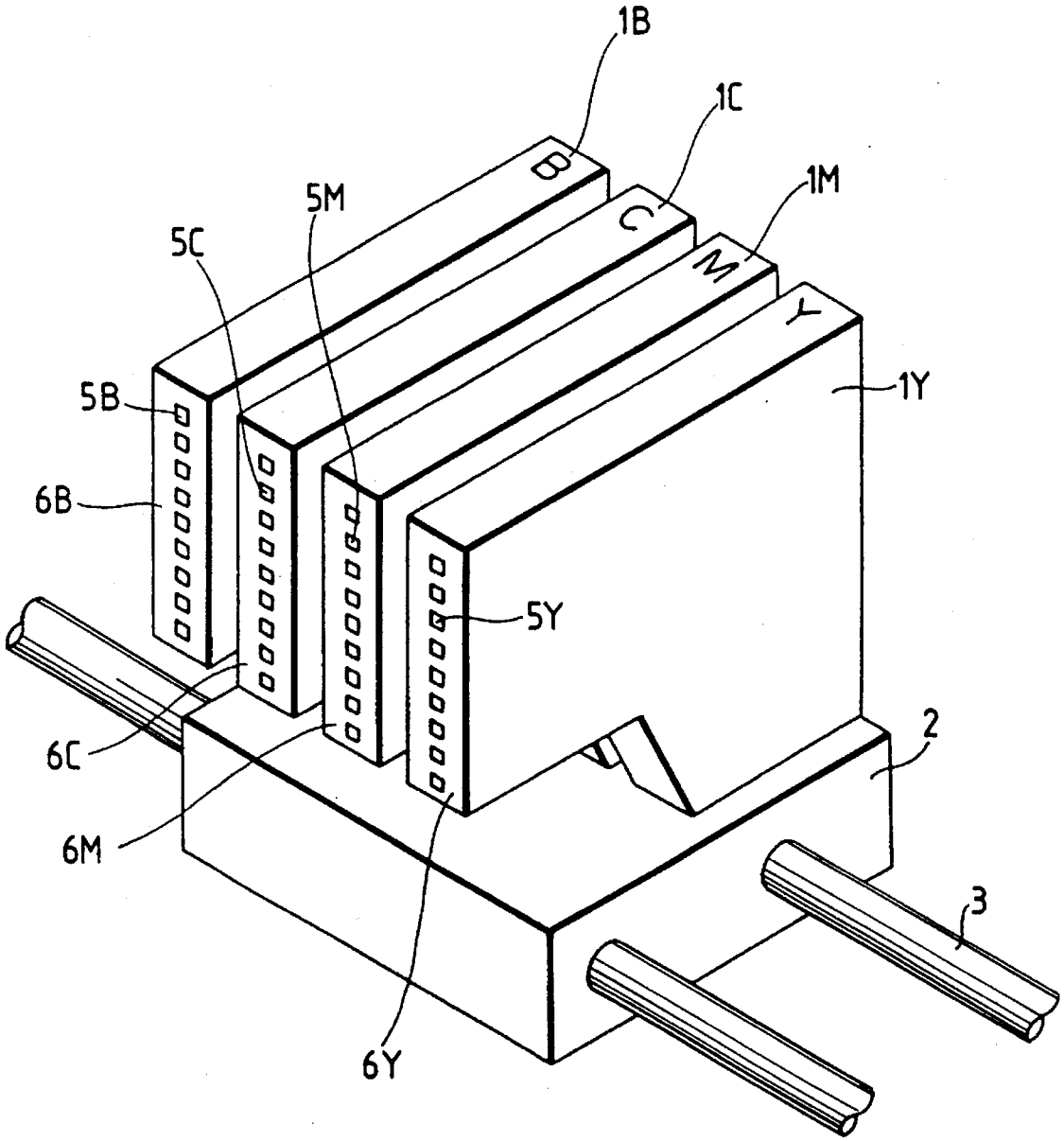
FIG. 6 PRIOR ART
FIG. 6 is a perspective view of the structure of recording heads in a conventional recording apparatus.
Figure 7B:
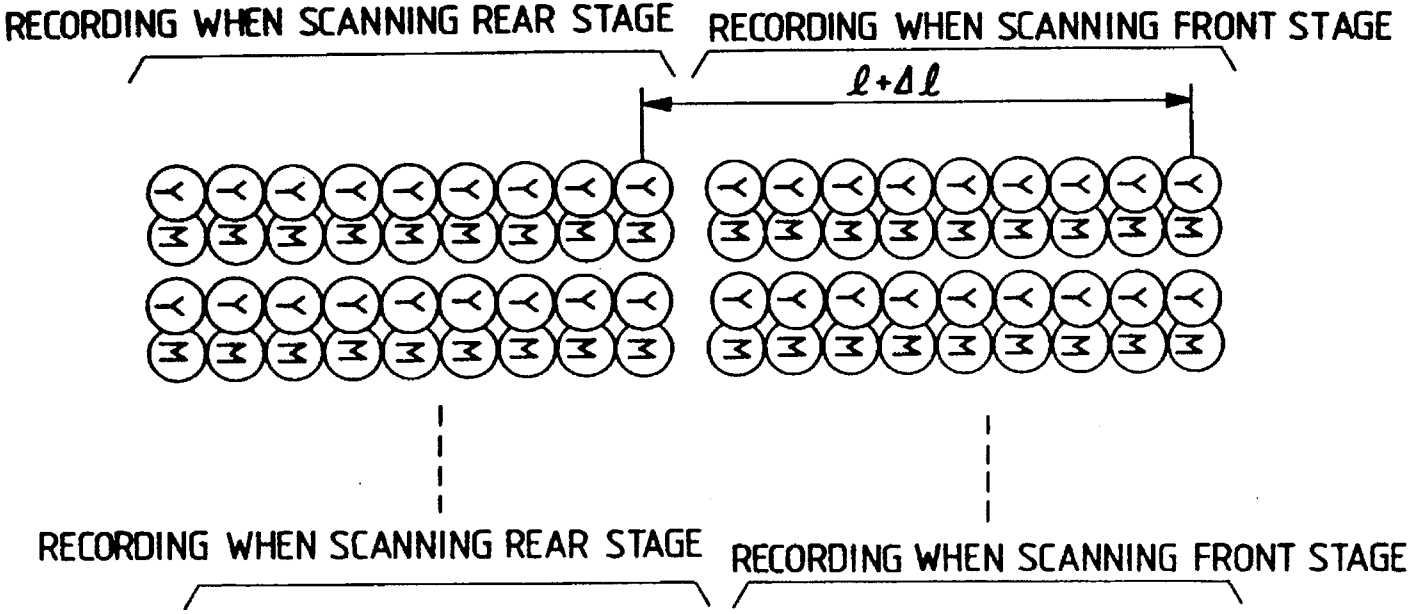
FIG. 7B PRIOR ART
FIGS. 7A and 7B are schematic views showing two examples of recording with conventional recording heads.
Figure 7A:
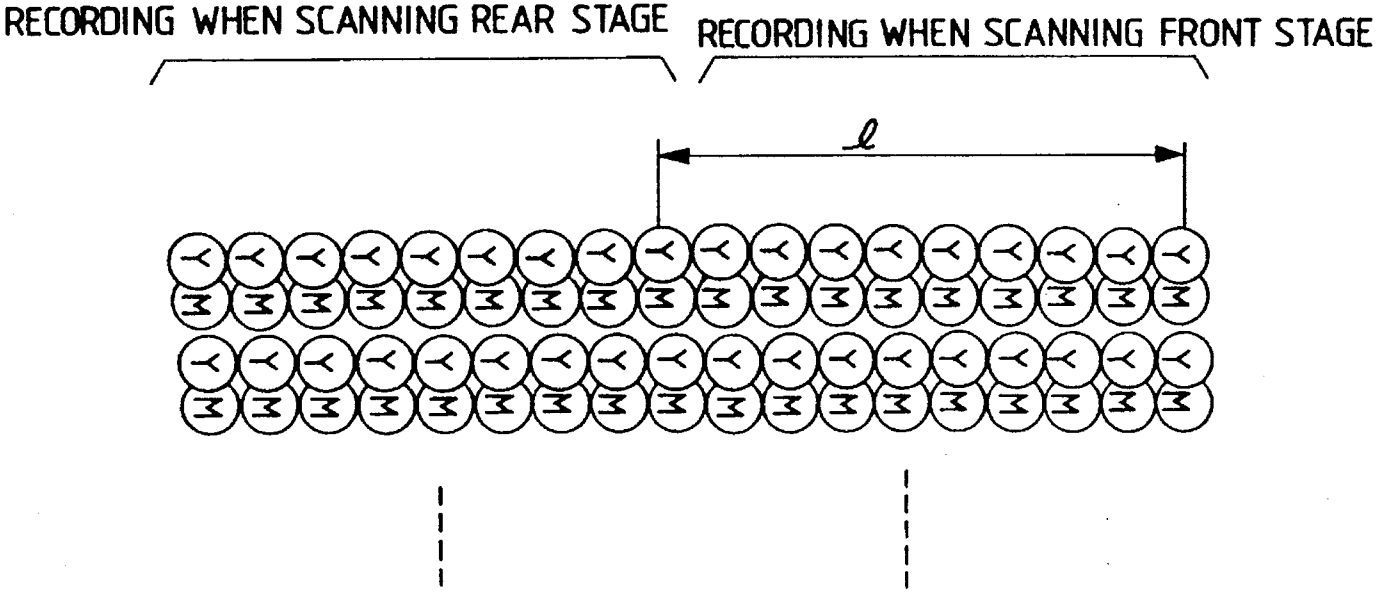
FIG. 7A PRIOR ART

FIG. 4 shows another embodiment of the present invention, in which the number of recording elements 5Y–5B in the recording heads 11Y–11B is made larger than that actually used in the recording. In the present embodiment, for a displacement of two dots between adjacent heads, each head is given 2×(4–1)=6 recording elements in excess of the actually required elements. In FIG. 4, white squares represent the unused or ineffective recording elements, and black squares represent used or effective recording elements.

As an example, consider heads (or discharge port arrays) 11Y–11B depicted, for example, in FIG. 4, which are scanned transverse to the advancement direction of the recording material in two scans. In such an example, the following observations would readily be apparent to one of ordinary skill in the art. In the first scan (one scan or FRONT STAGE), heads 11Y–11B may record by ejecting droplets on the recording material in seven areas or portions. During the first scan, the first area may have droplets ejected on it (i.e., is recordable) by only head 11Y; the second area may have droplets ejected on it by only heads 11Y and 11M; the third area may have droplets ejected on it by only heads 11Y, 11M, and 11C; the fourth area may have droplets ejected on it by all of heads 11Y, 11M, 11C, and 11B; the fifth area may have droplets ejected on it by only heads 11M, 11C, and 11B; the sixth area may have droplets ejected on it by only heads 11C and 11B; and the seventh area may have droplets ejected on it by only head 11B. Similarly to the example discussed above with reference to FIG. 3, during the second scan (subsequent scan different from the one scan or REAR STAGE), the fifth area noted above may have droplets ejected on it by only head 11Y; the sixth area noted above may have droplets ejected on it by only heads 11Y and 11M; and the seventh area noted above may have droplets ejected on it by only heads 11Y, 11M, and 11C.

In such structure, each of the recording heads 11Y–11B has to be provided with an increased number of recording elements, but, in case of a bubble jet recording head in which ink is discharged from an orifice by the pressure of bubbles generated by heating of the ink, an increase of several recording elements scarcely gives rise to the increase of cost in the manufacturing process, since each recording element is composed of the combination of a heat generating element, a liquid path and an ink discharge orifice.

In the foregoing embodiment, there has been explained an example in which the recording elements are displaced by two dots in the vertical direction between adjacent recording heads, but the amount of displacement is not limited to such example. In fact, in case each recording head is provided with n recording elements, a similar effect can be obtained by a displacement up to (n–1) dots. More specifically, the amount d of displacement between the adjacent heads can be arbitrarily selected within a range:

$$P \leqq d \leqq (n-1)p$$

and said amount d of displacement need not be constant among all the recording heads.

As explained in the foregoing the present invention, in which the position of plural recording elements in each recording head, or the usable range of said recording elements, is displaced by a predetermined amount in the feeding direction of the recording material among different recording heads, can prevent deterioration in the recording quality even in the presence of an error in the amount of feeding of the recording material, thereby maintaining a high level of quality in the recorded image.

As for its representative constitution and principle, for example, those by use of the basic principles disclosed in U.S. Pat. Nos. 4,723,129 and 4,740,796 are preferred. This system is applicable to either of the so called on-demand type and the continuous type. However, particularly in the case of the on-demand type, by applying at least one driving signal which gives quick temperature elevation in excess of nuclear boiling corresponding to the recording information to an electrothermal transducer arranged corresponding to the sheet or the liquid pathway where a liquid (ink) is held, heat energy is generated at the electrothermal transducer to effect film boiling at the heat acting surface of the recording head, thereby consequently effectively forming bubbles within the liquid (ink) corresponding one by one to the driving signal. By growth and shrinkage of such bubbles, the liquid (ink) is discharged through openings for discharge, to form at least one droplet. When the driving signal is made in pulse shape, growth and shrinkage can be effected instantly and adequately, whereby discharging of liquid (ink) particularly excellent in response characteristic can be more preferably accomplished. As the driving signal shaped in such pulse shape, those described in U.S. Pat. Nos. 4,463,359 and 4,345,262 are suitable. Further excellent recording can be effected by employment of the conditions described in U.S. Pat. No. 4,313,124 which concerns the temperature elevation rate of the above heat acting surface.

As the constitution of the recording head, in addition to the combined constitution of the discharge opening liquid pathway and the electrothermal transducer (linear liquid pathway or right angle liquid pathway), the constitutions by use of U.S. Pat. Nos. 4,558,333 and 4,459,600 disclosing the constitution wherein the heat acting portion is arranged in flexed region are also included in the present invention. Additionally, the present invention is also effective if the constitution may be made on the basis of Japanese Laid-open Patent Application No. 59-123670 disclosing the constitution with a slit common to a plurality of electrothermal transducers as the discharge portion of the electrothermal transducers or Japanese Laid-open Patent Application No. 59-138461 disclosing the constitution in which opening absorbing pressure wave heat energy are made corresponding to the discharge portion.

Further, as the recording head of the full-line type having a length corresponding to the maximum width of the recording medium which can be recorded with the recording device, either a constitution satisfying its length or a constitution formed integrally as one recording head according to the combination of the plurality of recording heads as disclosed in the above-mentioned specifications, but the present invention can exhibit the effects as described above further effectively.

In addition, the present invention is also effective for a recording head of the freely interchangeable chip type, which enables electrical connection to the main device and supply of ink from the main device by being mounted on the main device, or the case by use of a recording head of the cartridge type integrally provided on the recording head itself.

Also, the addition of a restoration means, a preliminary auxilary means of the recording head provided as the constitution of the recording device of the present invention is preferable, because the effects of the present invention can be further stabilized thereby. To mention these in more detail, capping means, cleaning means, pressurization or suction means, pre-heating means with an electrothermal transducer, another heating element different from this or a combination of these, and practice of preliminary discharge mode which performs discharge separately from recording are also effective for performing stable recording.

Further, as the recording mode of the recording device, the present invention is effective for not only the recording mode of the main color alone such as black, etc., but also for the device equipped with plural colors or at least one of full-color by color mixing, either by way of integrated constitution of recording heads or a combination of plural recording heads.

In the examples of the present invention as described above, ink is described as liquid, but even an ink which is solidified at room temperature or lower may be employed, provided that it is liquid when used for recording, since it is generally practiced to control the viscosity of the ink by temperature control under stable discharge range, which is softened or liquid at room temperature, or by temperature control of the ink itself within the range of 30° C. to 70° C. in the ink jet as described above. In addition, use of an ink having the property which is for the first time liquefied by heat energy is also applicable to the present invention, such as one in which temperature elevation of heat energy is positively prevented by using it as the energy for the state change from the solid state to the liquid state, or which is solidified under the state left to stand for the purpose of preventing evaporation of ink, anyway one which is discharged as ink liquid by liquefaction of ink by imparting heat energy corresponding to signals or one which already begins to be solidified when reaching the recording medium, etc. In such case, the ink may be made the state held as the liquid or solid product in concavities or thru-holes of a porous sheet, and in the form opposed to the electrothermal transducers, as described in Japanese Laid-open Patent Application No. 54-56847 or Japanese Laid-open Patent Application No. 60-71260. In the present invention, the most effective for the respective inks as described is one which implements the film boiling system as described above.

I claim:

1. A printing method for printing by integrally scanning first, second, third, and fourth arrays of discharge ports in a direction transverse to a conveying direction of a recording medium, each array comprising a plurality of discharge ports and each array capable of recording with one of black, cyan, magenta, and yellow colors, said method comprising the steps of:

scanning in one scan:

a first area recordable only with the first discharge port array, a second area recordable only with the first and second discharge port arrays, a third area recordable only with the first, second, and third discharge port arrays, a fourth area recordable only with the first, second, third, and fourth discharge port arrays, a fifth area recordable only with the second, third, and fourth discharge port arrays, a sixth area recordable only with the third and fourth discharge port arrays, and a seventh area recordable only with the fourth discharge port array, wherein, in a subsequent scan different from the one scan:

the fifth area is recordable only with the first discharge port array, the sixth area is recordable only with the first and second discharge port arrays, and the seventh area is recordable only with the first, second, and third discharge port arrays.

2. A printing method according to claim 1, wherein colors recorded by the first, second, third, and fourth discharge port arrays are black, cyan, magenta, and yellow, respectively.

3. A printing method according to claim 1, wherein the first, second, third, and fourth discharge port arrays are provided in respective recording heads and the recording heads each includes a plurality of heat generating elements for applying ink with energy to cause film boiling to form bubbles to emit ink droplets.

4. A printing method according to claim 1, wherein the first, second, third and fourth discharge port arrays are provided in respective heads and the recording heads comprise ink jet recording heads for discharging ink of different colors.

5. A printing method according to claim 1, wherein ink droplets emitted in the one scan by one of the discharge port arrays are not overlapped by ink droplets emitted by the same discharge port array in the subsequent scan.

6. A printing method according to claim 1, wherein each of the first, second, third, and fourth discharge port arrays is offset from each of the other discharge port arrays in the direction transverse to the conveying direction of the recording medium.

7. A printing method according to claim 1, wherein each respective plurality of discharge ports of the first, second, third, and fourth discharge port arrays comprises a group of effective discharge ports that includes all of the effective discharge ports for that respective discharge port array, and wherein each group of effective discharge ports of each of the first, second, third, and fourth discharge port arrays is offset from each of the other groups of effective discharge ports in the direction transverse to the conveying direction of the recording medium.

8. A printing apparatus for printing by a scanning operation, said printing apparatus comprising:

first, second, third, and fourth arrays of discharge ports, each array for recording with one of black, cyan, magenta, and yellow colors; and conveying means for conveying said discharge port arrays in a direction transverse to a conveying direction of a recording medium, wherein there are scanned in one scan:

a first area recordable only with said first discharge port array, a second area recordable only with said first and second discharge port arrays, a third area recordable only with said first, second, and third discharge port arrays, a fourth area recordable only with said first, second, third, and fourth discharge port arrays, a fifth area recordable only with said second, third, and fourth discharge port arrays, a sixth area recordable only with said third and fourth discharge port arrays, and a seventh area recordable only with said fourth discharge port array; and wherein, in a subsequent scan different from the one scan:

the fifth area is recordable only with said first discharge port array, the sixth area is recordable only with said first and second discharge port arrays, and the seventh area is recordable only with said first, second, and third discharge port arrays.

9. A printing apparatus according to claim 8, wherein said first, second, third, and fourth discharge port arrays are provided in respective recording heads and said recording heads each includes a plurality of heat generating elements for applying ink with energy to cause film boiling to form bubbles to emit ink droplets.

10. A printing apparatus according to claim 8, wherein said first, second, third and fourth discharge port arrays are provided in respective recording heads and said recording heads comprise ink jet recording heads for discharging ink of different colors.

11. A printing apparatus according to claim 8, wherein ink droplets emitted in the one scan by one of said discharge port arrays are not overlapped by ink droplets emitted by the same discharge port array in the subsequent scan.

12. A printing apparatus according to claim 8, wherein said first, second, third, and fourth discharge port arrays are spaced at equal intervals.

13. A printing apparatus according to claim 8, wherein said first, second, third, and fourth discharge port arrays are shifted in a vertical direction for each color.

14. A printing apparatus according to claim 8, wherein positions of effective discharge ports in said first, second, third, and fourth discharge port arrays are shifted in a vertical direction for each color.

15. A printing apparatus according to claim 8, wherein colors recorded by said first, second, third, and fourth discharge port arrays are black, cyan, magenta, and yellow, respectively.

16. A printing apparatus according to claim 8, wherein each of said first, second, third, and fourth discharge port arrays is offset from each of the other discharge port arrays in the direction transverse to the conveying direction of the recording medium.

17. A printing apparatus according to claim 8, wherein each respective plurality of discharge ports of said first, second, third, and fourth discharge port arrays comprises a group of effective discharge ports that includes all of the effective discharge ports for that respective discharge port array, and wherein each group of effective discharge ports of each of said first, second, third, and fourth discharge port arrays is offset from each of the other groups of effective discharge ports in the direction transverse to the conveying direction of the recording medium.

* * * * *

UNITED STATES PATENT AND TRADEMARK OFFICE

CERTIFICATE OF CORRECTION

PATENT NO. : 5,568,168

DATED : October 22, 1996

INVENTOR(S) : Watanabe

It is certified that error appears in the above-indentified patent and that said Letters Patent is hereby corrected as shown below:

COLUMN 3:

Line 13, "droplet is" should read --droplets--.

COLUMN 6:

Line 30, "includes" should read --include--; and
Line 33, "third" should read --third,--.

COLUMN 7:

Line 24, "includes" should read --include--; and
Line 28, "third" should read --third,--.

Signed and Sealed this

Fifteenth Day of April, 1997

Bruce Lehman

*Attest:*

BRUCE LEHMAN

*Attesting Officer*

*Commissioner of Patents and Trademarks*